US010354608B2

(12) United States Patent
Liao et al.

(10) Patent No.: US 10,354,608 B2
(45) **Date of Patent: *Jul. 16, 2019**

(54) DRIVING CIRCUIT OF DISPLAY PANEL AND DRIVING MODULE THEREOF, AND DISPLAY DEVICE AND METHOD FOR MANUFACTURING THE SAME

(71) Applicant: SITRONIX TECHNOLOGY CORP., Jhubei (TW)

(72) Inventors: Min-Nan Liao, Jhubei (TW); Chih-Ping Su, Jhubei (TW)

(73) Assignee: Sitronix Technology Corp., Jhubei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/920,903

(22) Filed: Mar. 14, 2018

(65) Prior Publication Data

US 2018/0204534 A1 Jul. 19, 2018

Related U.S. Application Data

(63) Continuation of application No. 14/133,978, filed on Dec. 19, 2013, now Pat. No. 9,953,608.

(60) Provisional application No. 61/748,829, filed on Jan. 4, 2013.

(51) Int. Cl.
*G09G 3/36* (2006.01)

(52) U.S. Cl.
CPC ..... *G09G 3/3696* (2013.01); *G09G 2310/027* (2013.01); *G09G 2310/0289* (2013.01); *Y10T 29/4913* (2015.01)

(58) Field of Classification Search
None
See application file for complete search history.

(56) References Cited

U.S. PATENT DOCUMENTS

2011/0148845 A1* 6/2011 Uehara ..... G09G 3/3629 345/212
2014/0002433 A1* 1/2014 Knausz ..... H03M 1/661 345/211
2014/0092338 A1* 4/2014 Miyazaki ..... G02F 1/13452 349/58

FOREIGN PATENT DOCUMENTS

JP WO 2012147672 A1 * 11/2012 ..... G02F 1/13452

* cited by examiner

*Primary Examiner* — Amr A Awad
*Assistant Examiner* — Maheen I Javed
(74) *Attorney, Agent, or Firm* — Rosenberg, Klein & Lee

(57) ABSTRACT

The present invention relates to a driving circuit of a display panel. A plurality of driving units produce a reference driving voltage according to a gamma voltage of a gamma circuit, respectively. A plurality of digital-to-analog converting circuits receive the reference driving voltages output by the plurality of driving units, and select one of the plurality of reference driving voltage as a data driving voltage according to pixel data, respectively. The plurality of digital-to-analog converting circuits transmit the plurality of data driving voltages to the display panel for displaying images. A voltage boost circuit is used for producing a first supply voltage and providing the first supply voltage to the plurality of digital-to-analog converting circuits. At least a voltage boost unit is used for producing a second supply voltage and providing the second supply voltage to the plurality of driving units.

14 Claims, 15 Drawing Sheets

DRIVING CIRCUIT OF DISPLAY PANEL AND DRIVING MODULE THEREOF, AND DISPLAY DEVICE AND METHOD FOR MANUFACTURING THE SAME

REFERENCE TO RELATED APPLICATION

This application is a Continuation Application of U.S. patent application Ser. No. 14/133,978 filed on Dec. 19, 2013, currently pending, which is based on Provisional Application Ser. No. 61/748,829, filed on Jan. 4, 2013 which are incorporated by reference.

FIELD OF THE INVENTION

The present invention relates generally to a driving circuit and the driving module thereof and to a display device and the method for manufacturing the same, and particularly to a driving circuit of a display panel and the driving module thereof and to a display device and the method for manufacturing the same.

BACKGROUND OF THE INVENTION

Modern technologies are developing prosperously. Novel information products are introduced daily for satisfying people's various needs. Early displays are mainly cathode ray tubes (CRTs). Owing to their huge size, heavy power consumption, and radiation hazardous to the heath of long-term users, traditional CRTs are gradually replaced by liquid crystal displays (LCDs). LCDs have the advantages of small size, low radiation, and low power consumption, and thus becoming the mainstream in the market.

In addition, thanks to the rapid advancement of fabrication technologies for panels in recent years, the manufacturing costs of touch panels have been reduced significantly. Consequently, touch panels are applied to general consumer electronic products, such as mobile phones, digital cameras, digital music players (MP3), personal digital assistants (PDAs), and global positioning system (GPS), extensively and gradually. In these electronic products, touch panels are disposed and used as displays for users' interactive input operations. Thereby, the friendliness of the communication interface between human and machine has been improved substantially and the efficiency of input operations has been enhanced as well.

Recently, mobile phones are developing prosperously; in particular, smartphones are developing rapidly. As mobile phones require lighter and thinner mechanisms, the size of materials and the number of components used in panels are required to shrink or reduce. Besides, for single-chip driving chip modules for liquid crystals, in order to make mechanisms smaller and easier for adoption as well as to increase the assembly yield and lower costs of modules, pruning external components has become the major trend. Moreover, in order to provide a wider range of voltages, for example, 2.3V~4.6V, given a single power supply and shrinking the area of the driving chips in display panels, manufacturers gradually propose driving methods for satisfying both of these two types of requirements.

The source drivers in general display devices adopt operational amplifiers (Op-amp) or voltage dividing using resistors for driving display panels. The driving circuit in display panels comprises a plurality of digital-to-analog converting circuits and a plurality of driving units. The plurality of digital-to-analog converting circuits receive pixel data, respectively, and convert the pixel data to a pixel signal. The plurality of digital-to-analog converting circuits transmit the plurality of pixel signals to the plurality of driving units, respectively, for generating driving signals. The plurality of driving units transmit the driving signals to the display panel, respectively, so that the display panel can display images. The driving circuit needs an external voltage boost circuit. In addition, for maintaining the level of the output signal of the digital-to-analog converting circuit, the voltage boost circuit needs to be coupled with a storage capacitor. Nonetheless, since the capacitance of the storage capacitor is large, 0.1 uF~4.7 uF approximately, external capacitor device has to be used, leading to an increase of the manufacturing cost. If the storage capacitor is disposed in the driving circuit, the area of the driving circuit will be increased.

Accordingly, the present invention provides a novel driving circuit of a display panel and the driving module thereof, and a display device and the method for manufacturing the same. According to the present invention, the area occupied by the external storage capacitor of the driving circuit is reduced or even no external storage capacitor is required. Hence, the problem described above can be solved.

SUMMARY

An objective of the present invention is to provide a driving circuit of a display panel and the driving module thereof, and a display device and the method for manufacturing the same. According to the present invention, a plurality of digital-to-analog converting circuits and a plurality of driving units use different supply voltages provided by the voltage boost circuit and the voltage boost unit, respectively, to shrink the area occupied by the storage capacitor connected externally to the driving circuit or even eliminate the external storage capacitor. Thereby, the purpose of saving circuit area, and hence the purpose of saving costs, can be achieved.

Another objective of the present invention is to provide a driving circuit of a display panel and the driving module thereof, and a display device and the method for manufacturing the same. According to the present invention, the differential unit and the output unit of the plurality of driving units use different supply voltages provided by the voltage boost circuit and the voltage boost unit, respectively, to improve the stability of the output voltage of the driving units.

A further objective of the present invention is to provide a driving circuit of a display panel and the driving module thereof, and a display device and the method for manufacturing the same. According to the present invention, the plurality of driving units include a gamma circuit disposed among the plurality of digital-to-analog converting circuits for reducing the usage of the plurality of driving units. Thereby, the purpose of saving circuit area, and hence the purpose of saving costs, can be achieved.

In order to achieve the objectives and effects described above, the present invention discloses a driving circuit of a display panel, which comprises a plurality of driving units, a plurality of digital-to-analog converting circuits, a voltage boost circuit, and at least a voltage boost unit. The plurality of driving units produce a reference driving voltage according to a gamma voltage of a gamma circuit, respectively. The plurality of digital-to-analog converting circuits receive the reference driving voltages output by the plurality of driving units, and select one of the plurality of reference driving voltage as a data driving voltage according to pixel data, respectively. The plurality of digital-to-analog converting circuits transmit the plurality of data driving voltages to the display panel for displaying images. The voltage boost circuit is used for producing a first supply voltage and providing the first supply voltage to the plurality of digital-to-analog converting circuits. At least a voltage boost unit is used for producing a second supply voltage and providing the second supply voltage to the plurality of driving units.

The present invention further discloses a driving circuit of a display panel, which comprises a flexible circuit board and a chip. The flexible circuit board is connected electrically with the display panel. The chip is disposed on the flexible circuit board, and comprises a plurality of driving units, a plurality of digital-to-analog converting circuits, a voltage boost circuit, and at least a voltage boost unit. The plurality of driving units produce a reference driving voltage according to a gamma voltage of a gamma circuit, respectively. The plurality of digital-to-analog converting circuits receive the reference driving voltages output by the plurality of driving units, and select one of the plurality of reference driving voltage as a data driving voltage according to pixel data, respectively. The plurality of digital-to-analog converting circuits transmit the plurality of data driving voltages to the display panel for displaying images. The voltage boost circuit is used for producing a first supply voltage and providing the first supply voltage to the plurality of digital-to-analog converting circuits. At least a voltage boost unit is used for producing a second supply voltage and providing the second supply voltage to the plurality of driving units.

The present invention further discloses a display device, which comprises a display panel, a flexible circuit board, and a chip. The display panel is used for displaying an image. The flexible circuit board is connected electrically with the display panel. The chip is disposed on the flexible circuit board and produces a plurality of data driving voltage to the display panel for displaying images. The chip comprises a plurality of driving units, a plurality of digital-to-analog converting circuits, a voltage boost circuit, and at least a voltage boost unit. The plurality of driving units produce a reference driving voltage according to a gamma voltage of a gamma circuit, respectively. The plurality of digital-to-analog converting circuits receive the reference driving voltages output by the plurality of driving units, and select one of the plurality of reference driving voltage as a data driving voltage according to pixel data, respectively. The plurality of digital-to-analog converting circuits transmit the plurality of data driving voltages to the display panel. The voltage boost circuit is used for producing a first supply voltage and providing the first supply voltage to the plurality of digital-to-analog converting circuits. At least a voltage boost unit is used for producing a second supply voltage and providing the second supply voltage to the plurality of driving units.

The present invention further discloses a driving circuit of a display device, which comprises a plurality of digital-to-analog converting circuits, a plurality of driving units, a voltage boost circuit, and at least a voltage boost unit. The plurality of digital-to-analog converting circuits receive a plurality of gamma voltages of a gamma circuit and select one of the plurality of gamma voltages as a reference driving voltage according to pixel data, respectively. The plurality of driving units receive the reference driving voltages output by the plurality of digital-to-analog converting circuits, respectively, produce a data driving voltage according to the reference driving voltage, and transmit the data driving voltage to the display panel for displaying images. The voltage boost circuit is used for producing a first supply voltage and providing the first supply voltage to the plurality of digital-to-analog converting circuits. At least a voltage boost unit is used for producing a second supply voltage and providing the second supply voltage to the plurality of driving units. Each driving unit comprises a differential unit and an output unit. The differential unit receives the first supply voltage, uses it as the supply voltage thereof, and produces a differential voltage according to the reference driving voltage. The output unit receives the second supply voltage, uses it as the supply voltage thereof, and produces the data driving voltage according to the differential voltage.

DETAILED DESCRIPTION

In the specifications and subsequent claims, certain words are used for representing specific devices. A person having ordinary skill in the art should know that hardware manufacturers may use different nouns to call the same device. In the specifications and subsequent claims, the differences in names are not used for distinguishing devices. Instead, the differences in functions are the guidelines for distinguishing. In the whole specifications and subsequent claims, the word "comprising" is an open language and should be explained as "comprising but not limited to". Beside, the word "couple" includes any direct and indirect electrical connection. Thereby, if the description is that a first device is coupled to a second device, it means that the first device is connected electrically to the second device directly, or the first device is connected electrically to the second device via other device or connecting means indirectly.

In order to make the structure and characteristics as well as the effectiveness of the present invention to be further understood and recognized, the detailed description of the present invention is provided as follows along with embodiments and accompanying figures.

Figure 1:
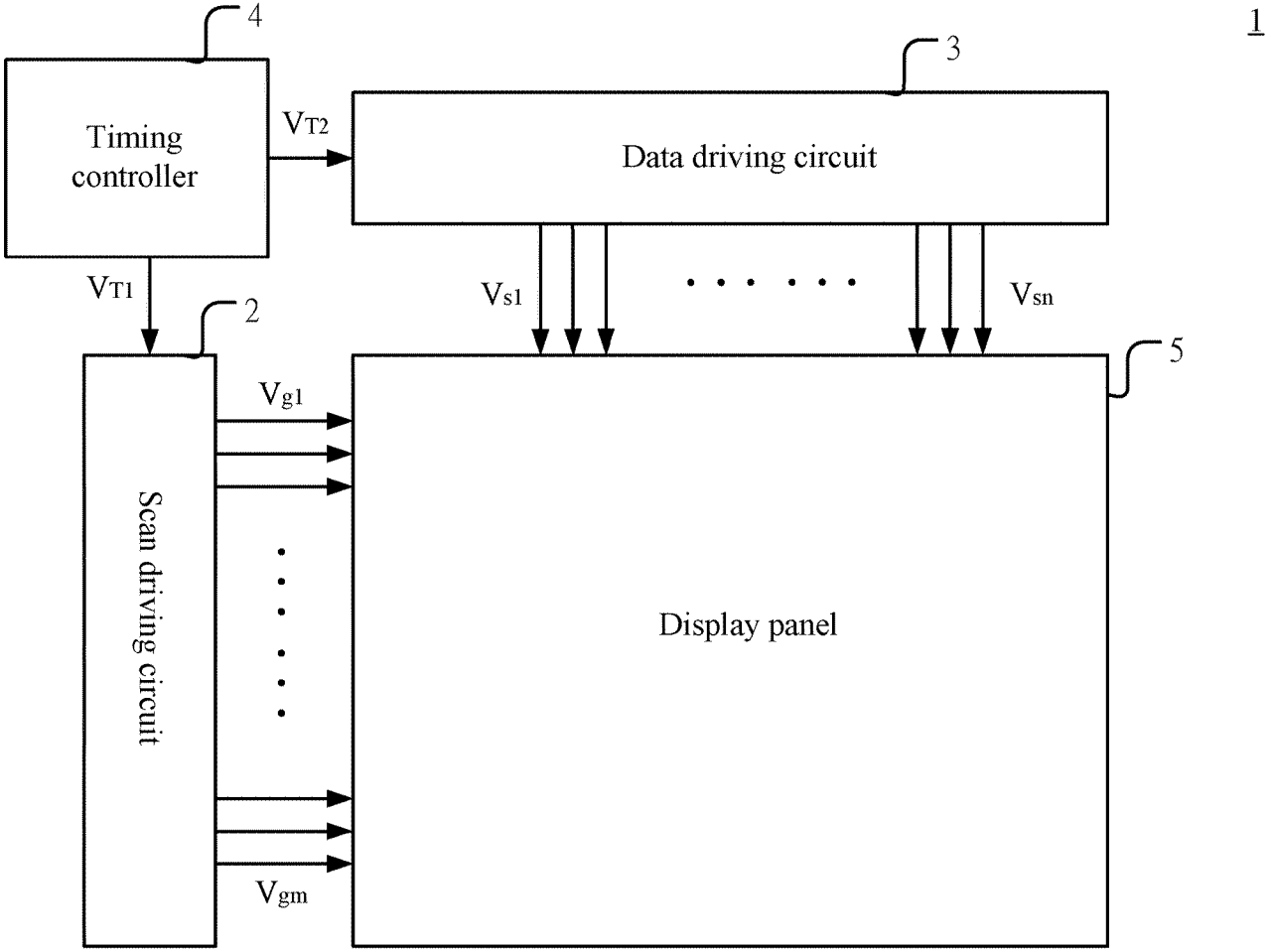
FIG. 1 shows a block diagram of the display device according to a preferred embodiment of the present invention.

Please refer to FIG. 1, which shows a block diagram of the display device according to a preferred embodiment of the present invention. As shown in the figure, the display device 1 according to the present invention comprises a scan driving circuit 2, a data driving circuit 3, a timing control circuit 4, and a display panel 5. The scan driving circuit 2 is used for producing a plurality of scan driving voltages $V_{g1}$~$V_{gm}$ and transmitting the plurality of scan driving voltages $V_{g1}$~$V_{gm}$ to the display panel 5 sequentially. The data driving circuit 3 is used for producing a plurality of data driving voltages $V_{s1}$~$V_{sn}$, and, corresponding to the plurality of scan driving voltages $V_{g1}$~$V_{gm}$, transmitting the plurality of data driving voltages $V_{s1}$~$V_{sn}$ to the display panel 5 for driving the display panel 5 to display images.

The timing control circuit 4 is used for generating a first timing signal $V_{T1}$ and a second timing signal $V_{T2}$. The timing control circuit 4 transmits the first timing signal $V_{T1}$ and the second timing signal $V_{T2}$ to the scan driving circuit 2 and the data driving circuit 3, respectively, for controlling the scan driving voltages $V_{g1}$~$V_{gm}$ transmitted to the display panel 5 by the scan driving circuit 2 to be synchronous with the data driving voltages $V_{s1}$~$V_{sn}$ transmitted to the display panel 5 by the data driving circuit 3. In other words, when the scan driving circuit 2 transmits the scan driving voltage $V_{g1}$ to the display panel 5, the data driving circuit 3 transmits the plurality of data driving voltages $V_{s1}$~$V_{sn}$ to the display panel 5 corresponding to the scan driving voltage $V_{g1}$ for driving the display panel 5 to display the image of the first row; when the scan driving circuit 2 transmits the scan driving voltage $V_{g2}$ to the display panel 5, the data driving circuit 3 transmits the plurality of data driving voltages $V_{s1}$~$V_{sn}$ to the display panel 5 corresponding to the scan driving voltage $V_{g2}$ for driving the display panel 5 to display the image of the second row, etc. Thereby, the display is driven to display a whole frame of image.

Figure 2:
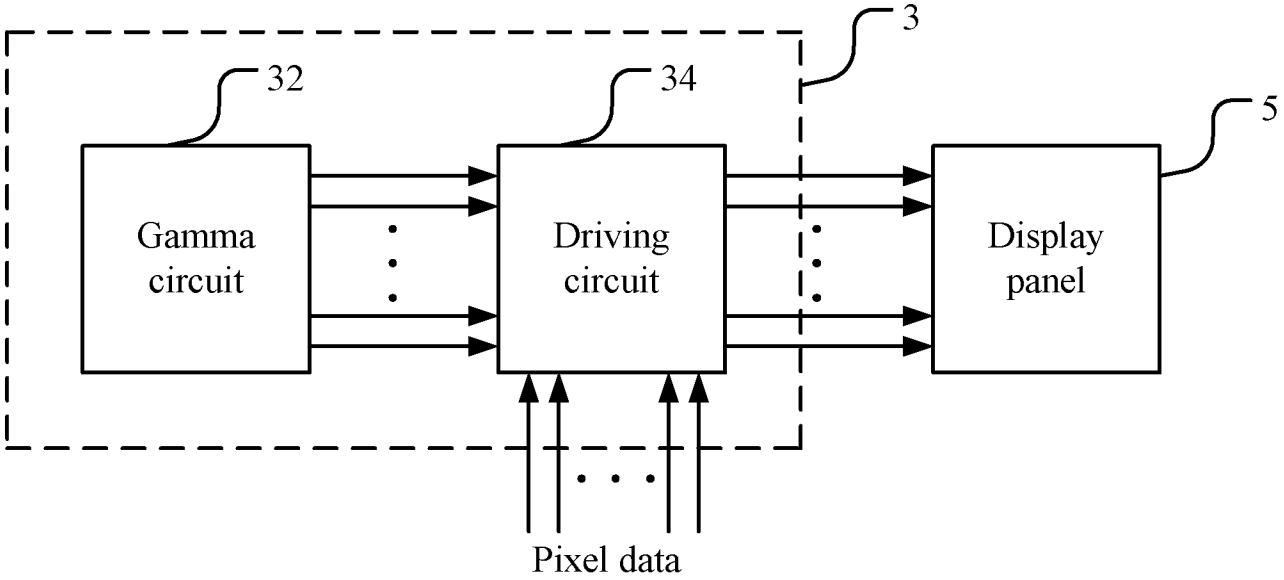
FIG. 2 shows a block diagram of the data driving circuit according to a preferred embodiment of the present invention.

Please refer to FIG. 2, which shows a block diagram of the data driving circuit according to a preferred embodiment of the present invention. As shown in the figure, the data driving circuit 3 comprises a gamma circuit 32 and a driving circuit 34. The gamma circuit 32 produces a plurality of gamma voltages according to a gamma curve. The gamma circuit 32 transmits the plurality of gamma voltages to the driving circuit 34. The plurality of gamma voltage are voltage signals having different levels. The driving circuit 34 receives the plurality of gamma voltages and a plurality of pixel data. The driving circuit 34 selects one of the plurality of gamma voltages according to the plurality of pixel data and produces the plurality of data driving voltages $V_{s1}$~$V_{sn}$ corresponding to the plurality of pixel data and transmits the plurality of data driving voltages $V_{s1}$~$V_{sn}$ to the display panel 5 for driving the display panel 5 to display images.

Figure 3:
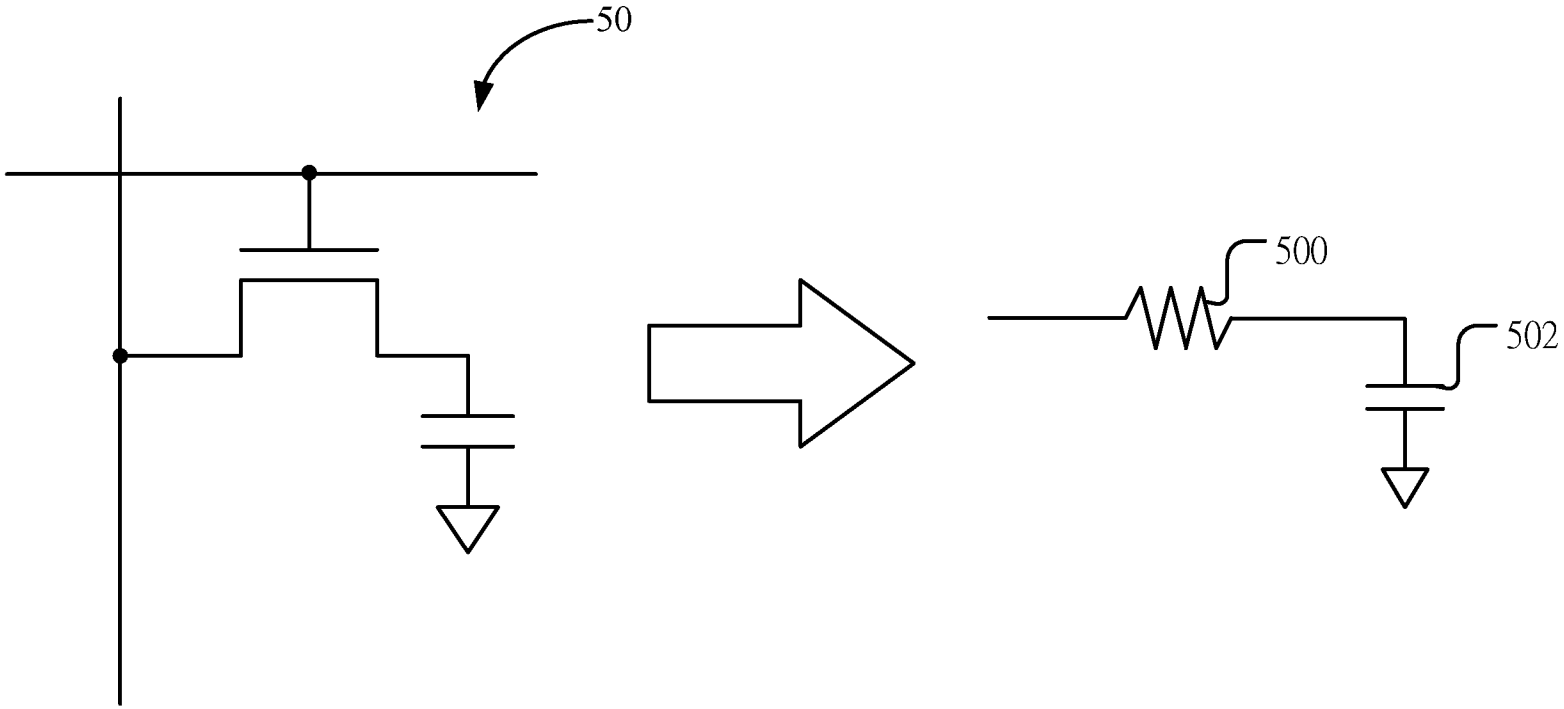
FIG. 3 shows an RC equivalent circuit of the pixel structure on a source line of the display panel according to the present invention.

Please refer to FIG. 3, which shows an RC equivalent circuit of the pixel structure on a source line of the display panel according to the present invention. As shown in the figure, according to a preferred embodiment of the present invention, the display panel 5 is a thin-film transistor liquid crystal display (TFT-LCD). The display panel 5 comprises a plurality of pixel structures 50 coupled to the driving circuit 34. The pixel structure 50 on each source line of the display panel 5 is a TFT. The pixel structure 50 is equivalent to a resistor 500 connected in series with a capacitor 502.

Figure 4:
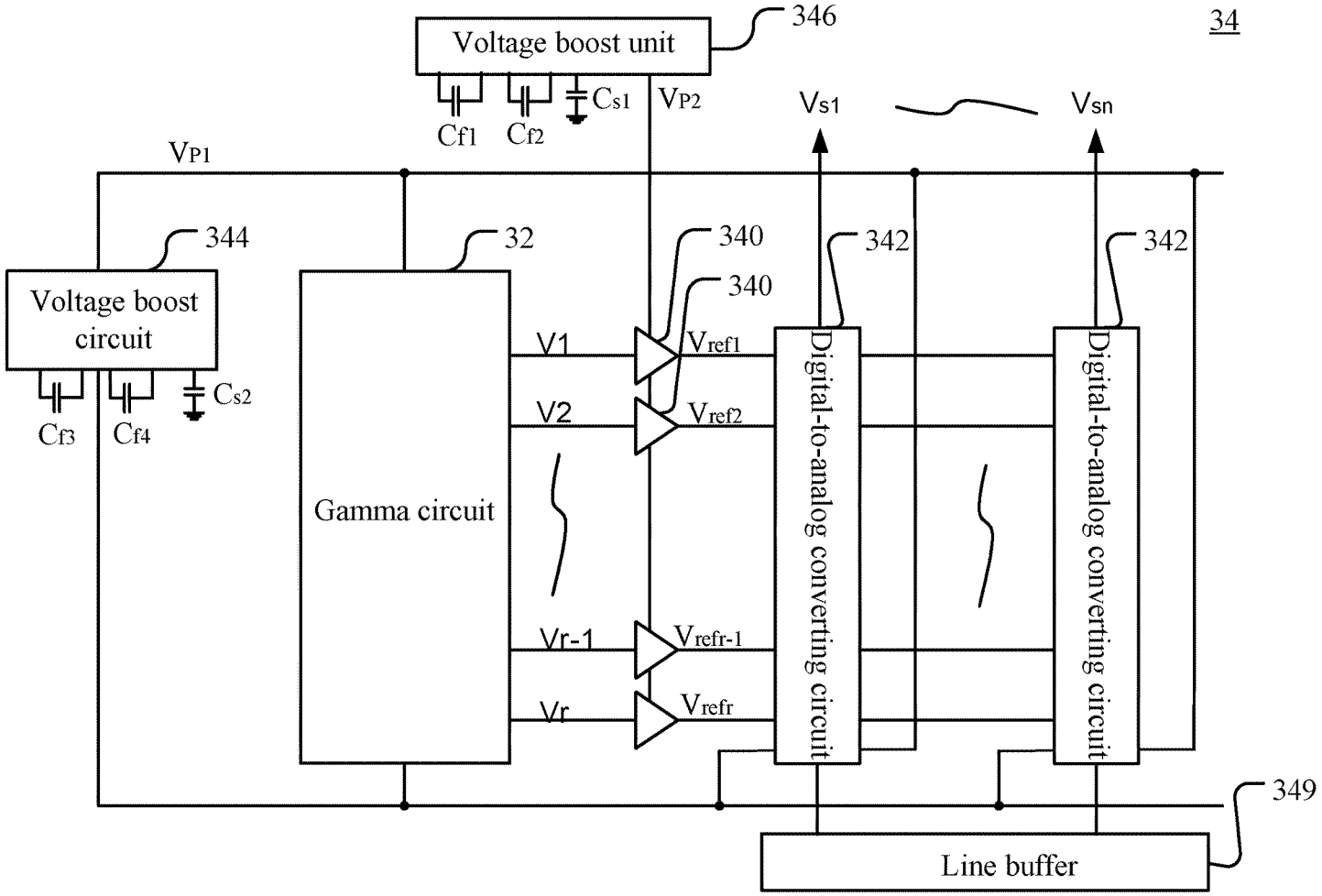
FIG. 4 shows a block diagram of the driving circuit of the display panel according to a first embodiment of the present invention.

Please refer to FIG. 4, which shows a block diagram of the driving circuit of the display panel according to a first embodiment of the present invention. As shown in the figure, the driving circuit 34 of the display panel 5 according to the present invention comprises a plurality of driving units 340, a plurality of digital-to-analog converting circuits 342, a voltage boost circuit 344, and at least a voltage boost unit 346. The plurality of driving units 340 are coupled to the gamma circuit 32. The plurality of driving units 340 produce a reference driving voltage according to the gamma voltages $V_1$~$V_r$ of the gamma circuit 32, respectively. Namely, a plurality of output lines of the gamma circuit 32 are coupled to the plurality of driving units 340, respectively. The gamma circuit 32 transmits the plurality of gamma voltages $V_1$~$V_r$ to the plurality of driving units 340 via the plurality of output lines, drives the plurality of driving units 340 to produce a plurality of reference driving voltages $V_{ref1}$~$V_{refr}$, respectively, and transmits the plurality of reference driving voltages $V_{ref1}$~$V_{refr}$ to the plurality of digital-to-analog converting circuits 342.

The plurality of digital-to-analog converting circuits 342 are coupled to the plurality of driving units 340, receive the plurality of reference driving voltages $V_{ref1}$~$V_{refr}$ and the plurality of pixel data transmitted by the plurality of driving units 340, and select one of the plurality of reference driving voltages $V_{ref1}$~$V_{refr}$ as a data driving voltage V. The plurality of digital-to-analog converting circuits 342 transmit the plurality of data driving voltages $V_{s1}$~$V_{sn}$ to the display panel 5 for displaying images. That is to say, each digital-to-analog converting circuit 342 will receive the plurality of reference driving voltages $V_{ref1}$~$V_{refr}$ and select one of the plurality of reference driving voltages $V_{ref1}$~$V_{refr}$ as the data driving voltage V. Thereby, the plurality of digital-to-analog converting circuits 342 produce the plurality of data driving voltages $V_{s1}$~$V_{sn}$ and transmit the plurality of data driving voltages $V_{s1}$~$V_{sn}$ to the display panel 5 for displaying images. The plurality of pixel data can be provided by a line buffer 349. Alternatively, as shown in FIG. 2, they can be provided by the inputs of the driving circuit 34.

The voltage boost circuit 344 is coupled to the gamma circuit 32 and the plurality of digital-to-analog converting circuits 342. In addition, the voltage boost circuit 344 is used for producing a first supply voltage $V_{P1}$ and providing the first supply voltage $V_{P1}$ to the gamma circuit 32 and the plurality of digital-to-analog converting circuits 342. At least a voltage boost unit 346 is coupled to the plurality of driving units 340, and used for producing a second supply voltage $V_{P2}$ and providing the second supply voltage $V_{P2}$ to the plurality of driving units 340. According to the present embodiment, only a voltage boost unit 346 is used for producing the second supply voltage $V_{P2}$ and providing the second supply voltage $V_{P2}$ to the plurality of driving units 340. The voltage boost unit 346 is coupled to the flying capacitors $C_{f1}$, $C_{f2}$ and the storage capacitor $C_{s1}$; the voltage boost circuit 344 is coupled to the flying capacitors $C_{f3}$, $C_{f4}$ and the storage capacitor $C_{s2}$. According to the above description, the plurality of driving units 340 and the plurality of digital-to-analog converting circuits 342 can have individual power supplies; the gamma circuit 32 and the plurality of driving units 340 can have individual power supplies. Accordingly, by providing individual voltages to the corresponding devices using the plurality of voltage boost units 346 and the voltage boost circuit 344, the areas of the external storage capacitors $C_{s1}$, $C_{s2}$ can be shrunk or the external storage capacitor $C_{s1}$ can be even eliminated. Thus, the purpose of saving circuit area can be achieved.

Besides, because the number of the source lines of the display panel is greater than the number of the output lines of the gamma circuit 32, according to the present embodiment, the usage of the plurality of driving units 340 can be reduced by disposing the plurality of driving units 340 between the gamma circuit 32 and the plurality of digital-to-analog converting circuits 342, namely, by disposing the plurality of driving units 340 at the output lines of the gamma circuit 32. Consequently, the circuit area is reduced and thus achieving the purpose of saving cost.

Moreover, the driving circuit according to the present invention further comprises a line buffer 349 used for buffering the plurality of pixel data and transmitting the plurality of pixel data to the plurality of digital-to-analog converting circuits 342.

Figure 5:
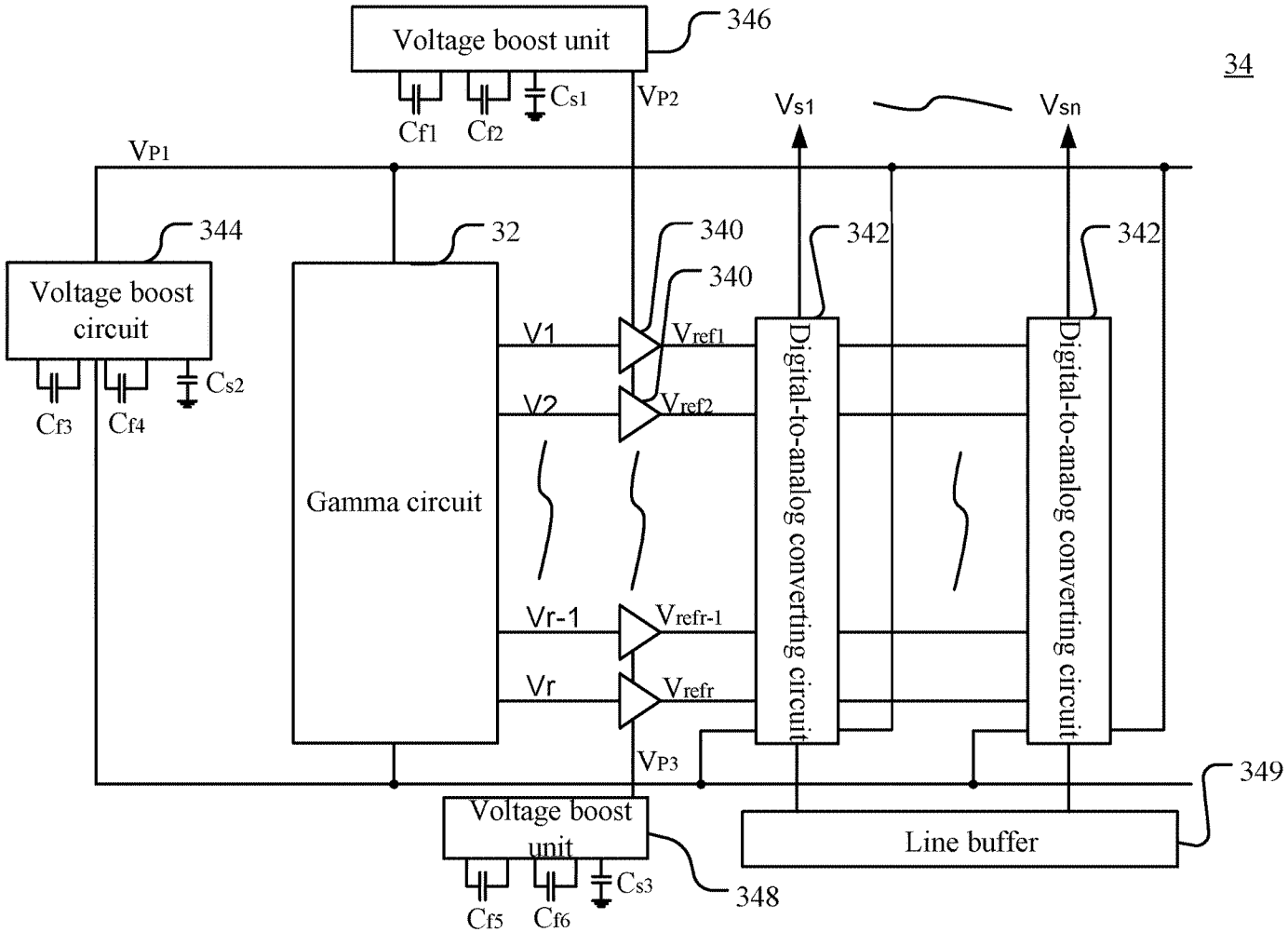
FIG. 5 shows a block diagram of the driving circuit of the display panel according to a second embodiment of the present invention.

Please refer to FIG. 5, which shows a block diagram of the driving circuit of the display panel according to a second embodiment of the present invention. As shown in the figure, the difference between the present embodiment and the one in FIG. 4 is that two voltage boost units 346, 348 are used in the present embodiment. The voltage boost units 346, 348 produce the second supply voltage $V_{P2}$ and a third supply voltage $V_{P3}$, respectively. The voltage boost unit 346 transmits the second supply voltage $V_{P2}$ to first half of the plurality of driving units 340, while the voltage boost unit 348 transmits the third supply voltage $V_{P3}$ to second half of the plurality of driving units 340. In addition, it is not required that the voltage boost units 346, 348 are responsible for a half of the plurality of driving units 340, respectively. They can be responsible for different proportions of the plurality of driving units 340. For example, the voltage boost unit 346 is responsible for the first one-third of the plurality of driving units 340, while the voltage boost unit 348 is responsible for the remaining two-thirds of the plurality of driving units 340. Alternatively, the voltage boost unit 346 is responsible for the first quarter of the plurality of driving units 340, while the voltage boost unit 348 is responsible for the remaining three quarters of the plurality of driving units 340.

Beside, the present invention is not limited to using one or two voltage boost units. The scope of present invention ranges from one voltage boost unit corresponding to the plurality of driving units 340 to one voltage boost unit corresponding to one driving unit 340.

Figure 6:
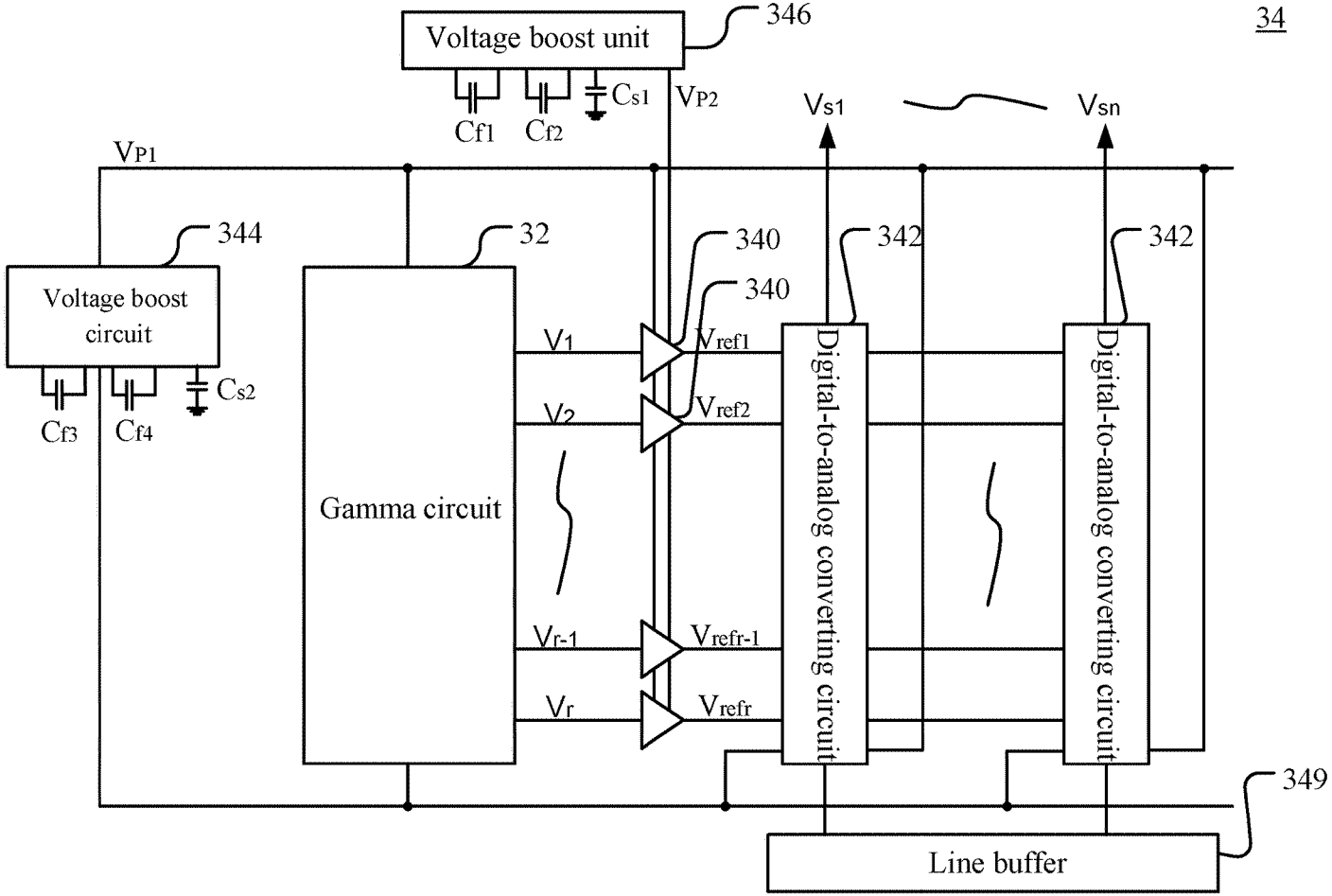
FIG. 6 shows a block diagram of the driving circuit of the display panel according to a third embodiment of the present invention.
Figure 7:
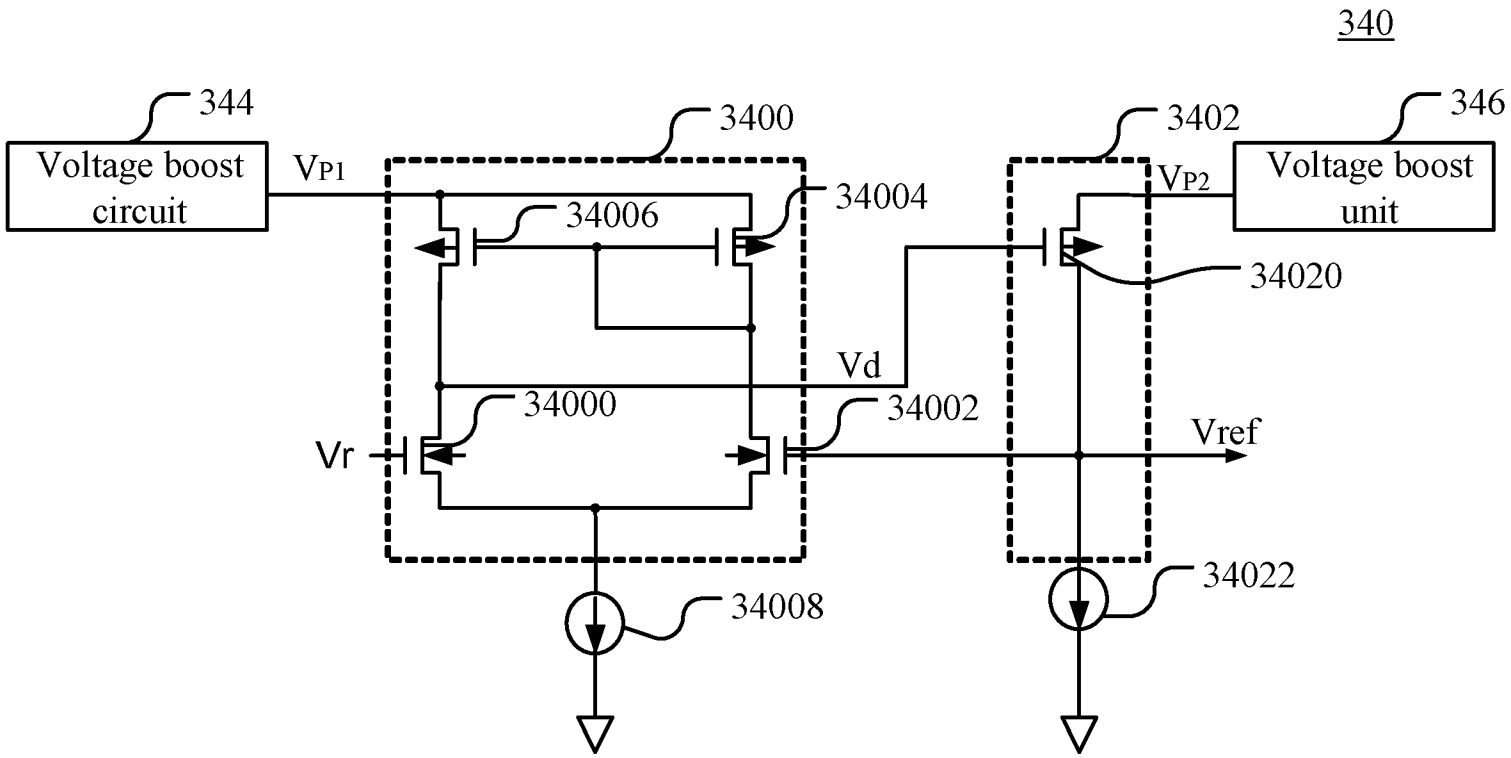
FIG. 7 shows a circuit diagram of the driving unit according a first embodiment of the present invention.

Please refer to FIG. 6 and FIG. 7. FIG. 6 shows a block diagram of the driving circuit of the display panel according to a third embodiment of the present invention; FIG. 7 shows a circuit diagram of the driving unit according to a first embodiment of the present invention. As shown in the figures, the difference between the present embodiment and the one in FIG. 4 is that the plurality of driving units 340 according to the present embodiment receive the first supply voltage $V_{P1}$ produced by the voltage boost circuit 344 and the second supply voltage $V_{P2}$ produced by the voltage boost unit 346 simultaneously. As shown in FIG. 7, the driving unit 340 according to the present invention comprises a differential unit 3400 and an output unit 3402. The differential unit 3400 receives the first supply voltage $V_{P1}$, uses it as the power supply of the differential unit 3400, and producing a differential voltage $V_d$ according to the gamma voltage Vr. The output unit 3402 receives the second supply voltage $V_{P2}$, uses it as the power supply of the output unit 3402, and producing the reference driving voltage $V_{ref}$ according to the differential voltage $V_d$.

The differential unit 3400 according to the present embodiment comprises a transistor 34000, a transistor 34002, a transistor 34004, a transistor 34006, and a current source 34008. The gate of the transistor 34000 is coupled to the output of the gamma circuit 32 for receiving the gamma voltage output by the gamma circuit 32. A first terminal of the transistor 34000 is coupled to a first terminal of the transistor 34002. The gate of the transistor 34002 is coupled to the output of the driving unit 340. A second terminal of the transistor 34002 is coupled to a first terminal of the transistor 34004. A second terminal of the transistor 34004 is coupled to the power supply for receiving the first supply voltage $V_{P1}$ provided by the voltage boost circuit 344. The gate of the transistor 34004 is coupled to the gate of the transistor 34006 and the first terminal of the transistor 34004. A first terminal of the transistor 34006 is coupled to a second terminal of the transistor 34000. A second terminal of the transistor 34006 is coupled to the power supply for receiving the first supply voltage $V_{P1}$ provided by the voltage boost circuit 344. A first terminal of the current source 34008 is coupled to the first terminal of the transistor 34000 and the first terminal of the transistor 34002. A second terminal of the current source 34008 is coupled to the reference voltage.

In addition, the output unit 3402 according to the present embodiment comprises a transistor 34020 and a current source 34022. The gate of the transistor 34020 is coupled to the second terminal of the transistor 34000 and the first terminal of the transistor 34006. The first terminal of the transistor 34020 is coupled to the output of the driving unit 340. The second terminal of the transistor 34020 is coupled to the power supply for receiving the second supply voltage $V_{P2}$ provided by the voltage boost unit 346. A first terminal of the current source 34022 is coupled to the output of the driving unit 340. A second terminal of the current source 34022 is coupled to the reference voltage. The differential units 3400 of the plurality of driving units 340 and the output unit 3402 use the voltage boost circuit 344 and the voltage boost unit 346, respectively, to provide individual voltages to their corresponding devices. Consequently, the stability of the output voltage of the driving unit 340 is enhanced.

In addition to using individual supply voltages provided by the voltage boost circuit 344 and voltage boost unit 346, respectively, the differential units 3400 of the plurality of driving units 340 and the output unit 3402 according to the present invention can also receive the second supply voltage $V_{P2}$ provided by the voltage boost unit 346 simultaneously.

Figure 8:
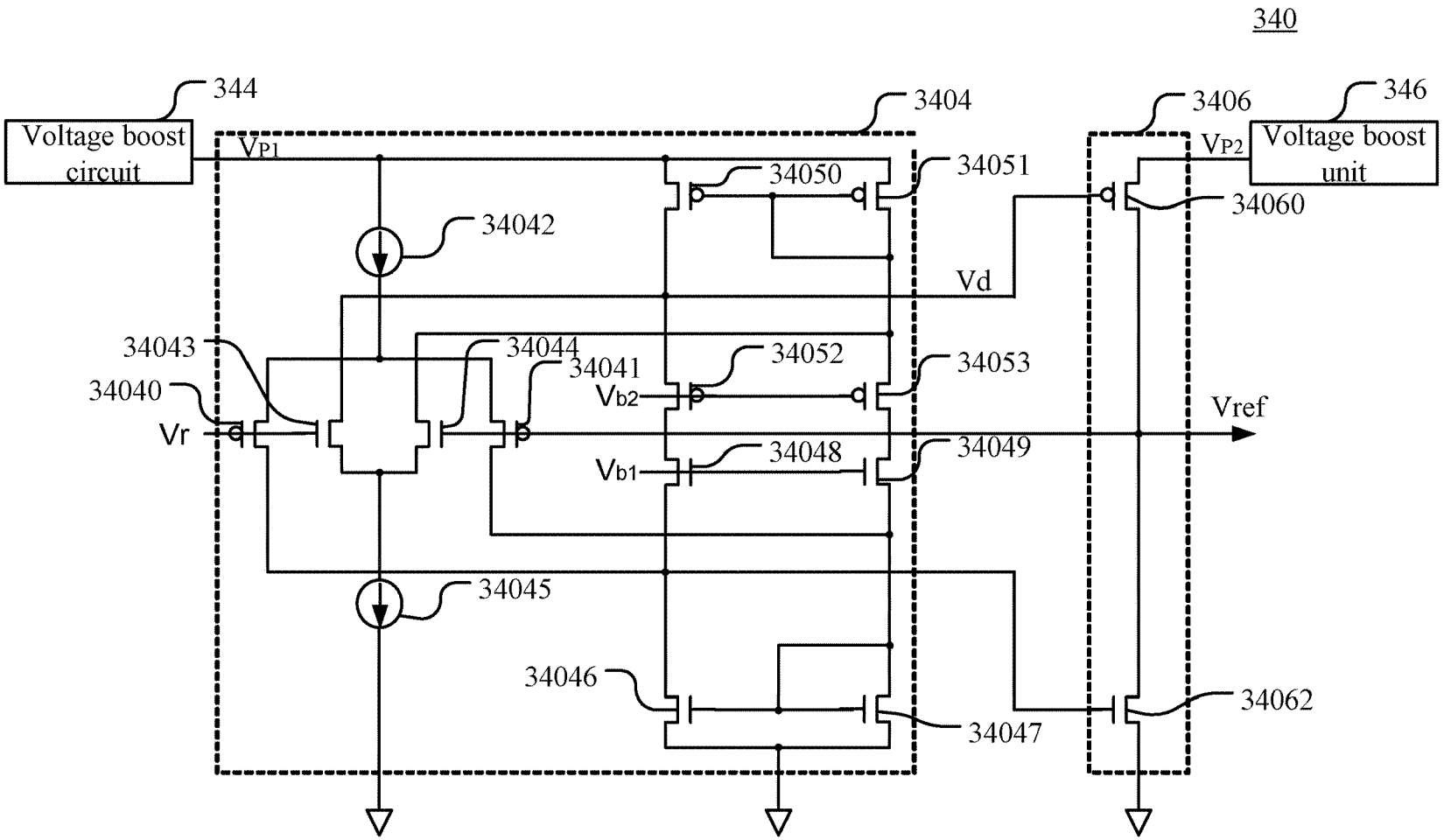
FIG. 8 shows a circuit diagram of the driving unit according a second embodiment of the present invention.

Please refer to FIG. 8, which shows a circuit diagram of the driving unit according a second embodiment of the present invention. As shown in the figure, the difference between the present embodiment and the one in FIG. 7 is that the driving unit 340 according to the present embodiment adopts a rail-to-rail differential unit 3404. Thereby, the driving unit 340 according to the present embodiment comprises the differential unit 3404 and an output unit 3406. The differential unit 3404 comprises transistors 34040~34053.

The gate of the transistor 34040 is coupled to the output of the gamma circuit 32. A first terminal of the transistor 34040 is coupled to a first terminal of the transistor 34041. A second terminal of the transistor 34040 is coupled between the transistor 34046 and the transistor 34048. The gate of the transistor 34041 is coupled to the output of the driving unit 340. A second terminal of the transistor 34041 is coupled between the transistor 34047 and the transistor 34049. A first terminal of the current source 34042 is coupled to the first terminal of the transistor 34040 and the first terminal of the transistor 34041. A second terminal of the current source 34042 is coupled to the power supply for receiving the first supply voltage $V_{P1}$ provided by the voltage boost circuit 344. The gate of the transistor 34043 is coupled to the output of the gamma circuit 32. A first terminal of the transistor 34043 is coupled to a first terminal of the transistor 34044. A second terminal of the transistor 34043 is coupled between the transistor 34050 and the transistor 34052. The gate of the transistor 34044 is coupled to the output of the driving unit 340. A second terminal of the transistor 34044 is coupled between the transistor 34051 and the transistor 34053. A first terminal of the current source 34045 is coupled to the first terminal of the transistor 34043 and the first terminal of the transistor 34044. A second terminal of the current source 34045 is coupled to the reference voltage.

The gate of the transistor 34046 according to the present embodiment is coupled to the gate of the transistor 34047. A first terminal of the transistor 34046 is coupled to the reference voltage. A second terminal of the transistor 34046 is coupled to a first terminal of the transistor 34048. A first terminal of the transistor 34047 is coupled to the reference voltage. A second terminal of the transistor 34047 is coupled to the gate of the transistor 34047 and a first terminal of the transistor 34049. The gate of the transistor 34048 receives a first reference voltage $V_{b1}$. A second terminal of the transistor 34048 is coupled to a first terminal of the transistor 34052. The gate of the transistor 34049 receives the first reference voltage $V_{b1}$. A second terminal of the transistor 34049 is coupled to a first terminal of the transistor 34053.

The gate of the transistor 34050 is coupled to the gate of the transistor 34051. A first terminal of the transistor 34050 is coupled to a second terminal of the transistor 34052. A second terminal of the transistor 34050 is coupled to the power supply for receiving the first supply voltage $V_{P1}$ output by the voltage boost circuit 344. A first terminal of the transistor 34051 is coupled to a second terminal of the transistor 34053 and the gate of the transistor 34051. A second terminal of the transistor 34051 is coupled to the power supply for receiving the first supply voltage $V_{P1}$ output by the voltage boost circuit 344. The gates of the transistor 34052, 34053 receive a second reference voltage $V_{b2}$.

The output unit 3406 according to the present embodiment comprises a transistor 34060 and a transistor 34062. The gate of the transistor 34060 is coupled to the first terminal of the transistor 34050, the second terminal of the transistor 34052, and the second terminal of the transistor 34043. A first terminal of the transistor 34060 is coupled a first terminal of the transistor 34062 and the output of the driving unit 340. A second terminal of the transistor 34060 is coupled to the power supply for receiving the second supply voltage $V_{P2}$ output by the voltage boost unit 346. The gate of the transistor 34062 is coupled to the second terminal of the transistor 34046, the first terminal of transistor 34048, and the second terminal of the transistor 34040. A second terminal of the transistor 34062 is coupled to the reference voltage. Thereby, the influence of significant variation of output current due to the load on the power supply of the differential units 3404 of the plurality of driving units 340, and hence on the levels of the differential voltage $V_d$ output by the differential units 3404, can be avoided. Accordingly, the differential units 3404 and the output units 3406 according to the present embodiment use individual voltages provided by the voltage boost circuit 344 and the voltage boost unit 346, respectively, for improving the stability of the voltages output by the driving units 340.

Figure 9:
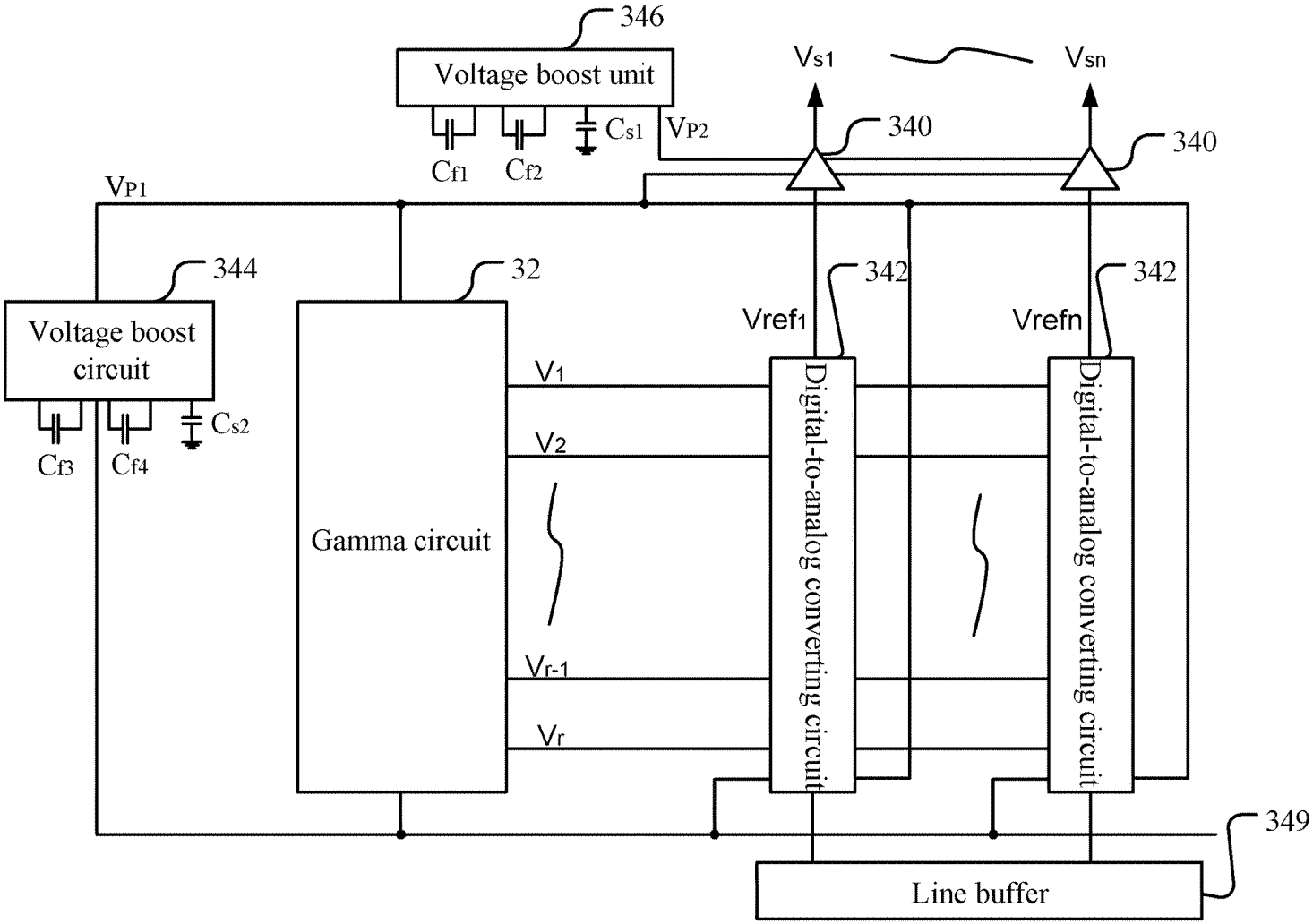
FIG. 9 shows a block diagram of the driving circuit of the display panel according to a fourth embodiment of the present invention.

Please refer to FIG. 9, which shows a block diagram of the driving circuit of the display panel according to a fourth embodiment of the present invention. As shown in the figure, the difference between the present embodiment and the one in FIG. 6 is that the locations of the plurality of driving units 340 according to the present embodiment and the location of the plurality of digital-to-analog converting circuits 342 are exchanged. In other words, the output of the gamma circuit 32 is coupled to the plurality of digital-to-analog converting circuits 342; the outputs of the plurality of digital-to-analog converting circuits are coupled to the plurality of driving units 340, respectively. Namely, the plurality of digital-to-analog converting circuit 342 receive the plurality of gamma voltages $V_1$~$V_r$ of the gamma circuit 32 and select one of the plurality of gamma voltages $V_1$~$V_r$ as a reference driving voltage $V_{ref}$ according to the pixel data, respectively. The plurality of driving units 340 receive the reference driving voltages $V_{ref1}$~$V_{refn}$ output by the plurality of digital-to-analog converting circuits 342, respectively, produce a data driving voltage Vs according to the reference driving voltage $V_{ref}$, and transmit the data driving voltage Vs to the display panel 5 for displaying images. The voltage boost circuit 344 and the voltage boost unit 346 are identical to the embodiment in FIG. 6. Hence, the details will not be described again.

As the embodiment in FIG. 6, the plurality of driving units 340 according to the present embodiment receive the first supply voltage $V_{P1}$ produced by the voltage boost circuit 344 and the second supply voltage $V_{P2}$ produced by the voltage boost unit 346 simultaneously. Take FIG. 7 for example. The differential unit 3400 receives the first supply voltage $V_{P1}$ and uses it as the power supply thereof; the output unit 3402 receives the second supply voltage $V_{P2}$ and uses it the power supply thereof. Accordingly, the differential units 3404 and the output units 3406 of the plurality of driving units in the driving circuit of a display panel according to the present embodiment can also use individual voltages provided by the voltage boost circuit 344 and the voltage boost unit 346, respectively, for improving the stability of the voltages output by the driving units 340.

Figure 10:
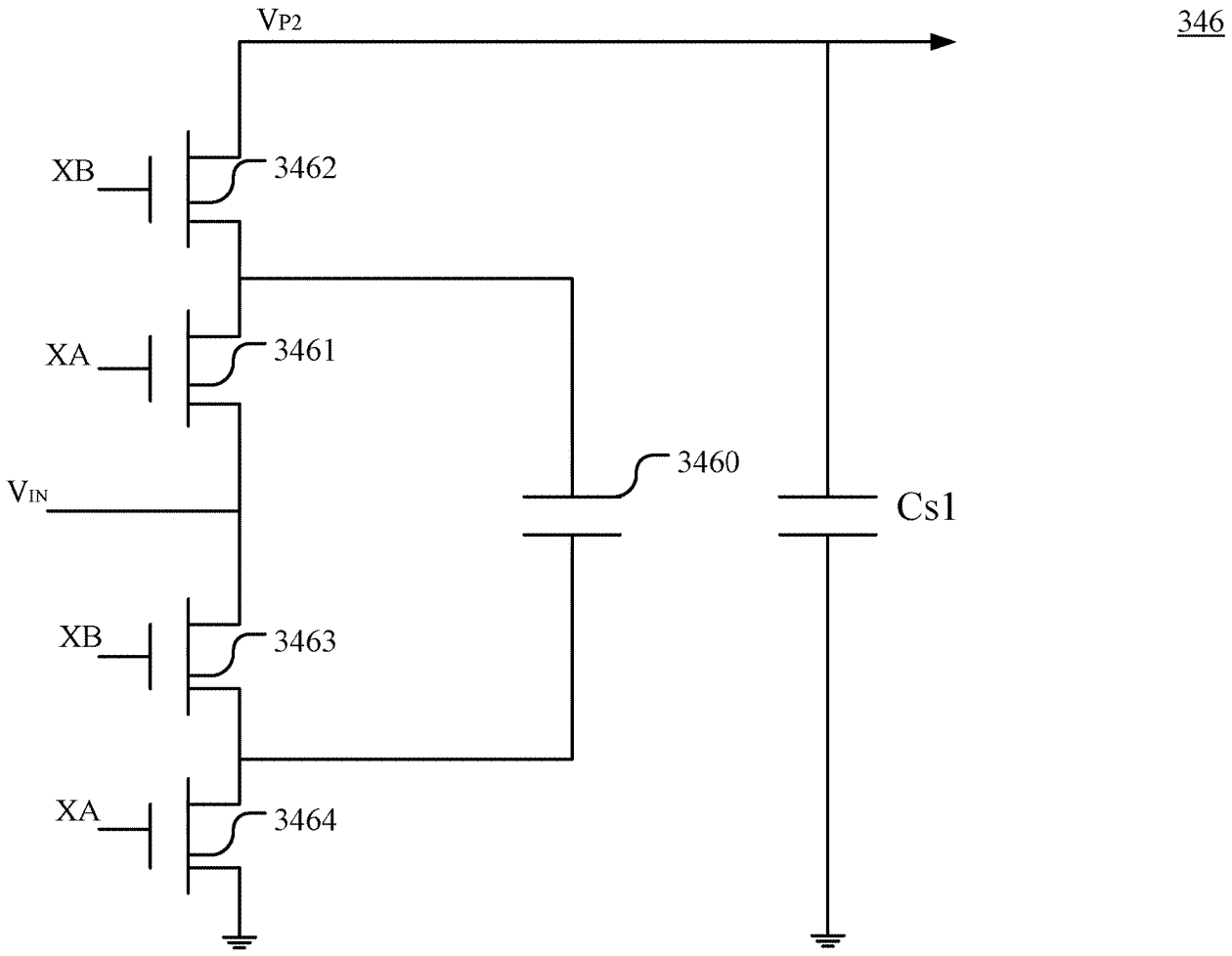
FIG. 10 shows a circuit diagram of the voltage boost unit according a first embodiment of the present invention.

Please refer to FIG. 10, which shows a circuit diagram of the voltage boost unit according a first embodiment of the present invention. As shown in the figure, the voltage boost unit 346 according to the present embodiment can be capacitive voltage boost circuit. The voltage boost unit 346 comprises a flying capacitor 3460, transistors 3461~3464, and a storage capacitor $C_{s1}$. The flying capacitor 3460 is used for producing the second supply voltage $V_{P2}$. A terminal of the transistor 3461 is coupled to a terminal of the flying capacitor 3460. The other terminal of the transistor 3461 receives an input voltage $V_{IN}$ and is controlled by a first control signal XA. The transistor 3462 is coupled to the flying capacitor 3460 and the transistor 3461 and controlled by a second control signal XB for outputting the second supply voltage $V_{P2}$. A terminal of the transistor 3463 is coupled to the other terminal of the flying capacitor 3460. The other terminal of the transistor 3463 receives the input voltage $V_{IN}$ and is controlled by the second control signal XB. A terminal of the transistor 3464 is coupled to the flying capacitor 3460 and the transistor 3463. The other terminal of the transistor 3464 is coupled to a ground and controlled by the first control signal XA. Besides, a terminal of the storage capacitor $C_{s1}$ is coupled to the transistor 3462; the other terminal of the storage capacitor $C_{s1}$ is coupled to the ground for storing and outputting the second supply voltage $V_{P2}$. Thereby, after receiving the input voltage $V_{IN}$, the voltage boost unit 346 according to the present embodiment uses the first control signal XA and the second control signal XB to control the transistors 3461~3464 for producing the second supply voltage $V_{P2}$ and outputting the second supply voltage $V_{P2}$ to the plurality of driving units 340.

Figure 11:
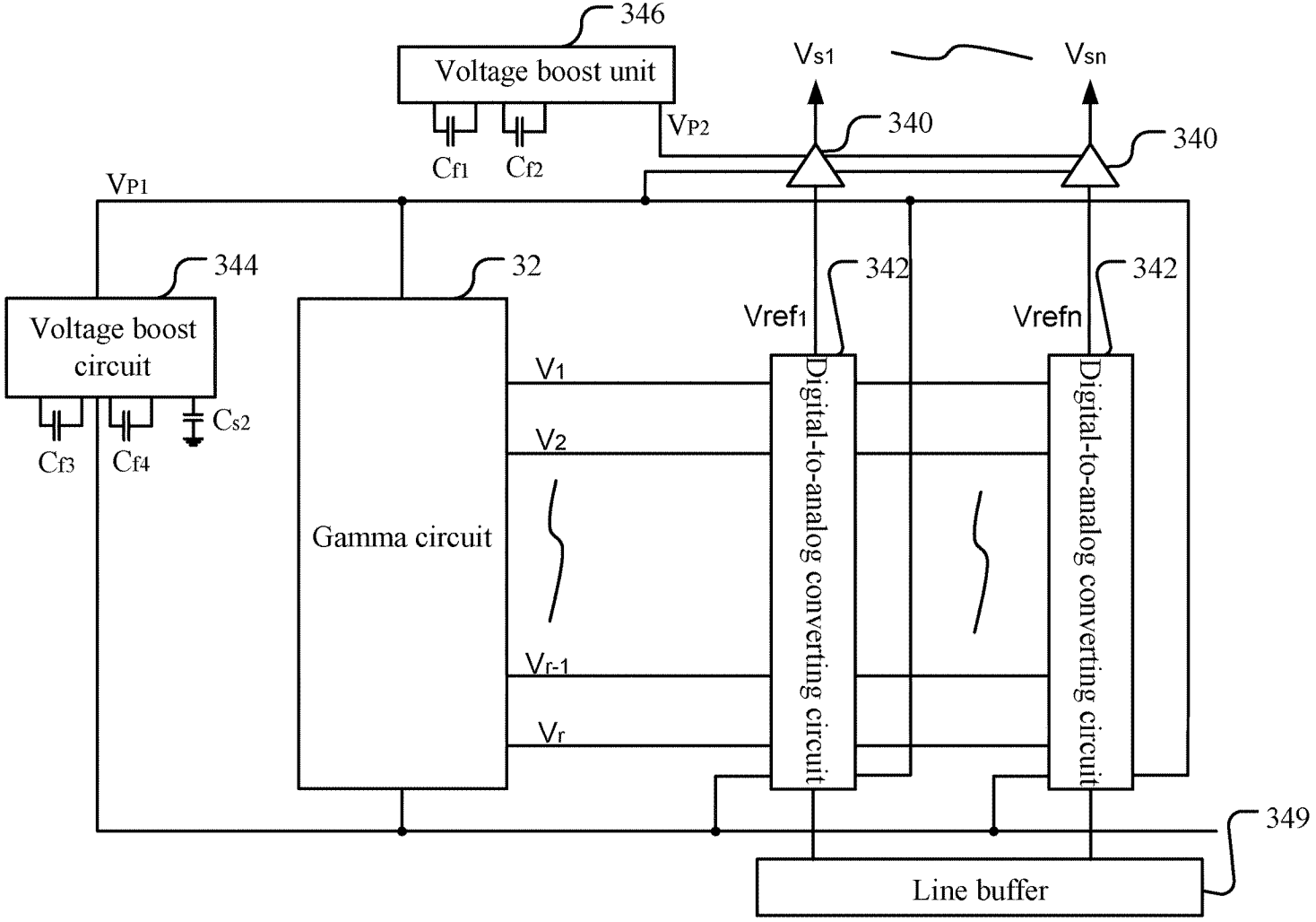
FIG. 11 shows a block diagram of the driving circuit of the display panel according to a fifth embodiment of the present invention.

Please refer to FIG. 11, which shows a block diagram of the driving circuit of the display panel according to a fifth embodiment of the present invention. As shown in the figure, the difference between the present embodiment and the previous one is that the voltage boost unit 346 according to the present embodiment requires no storage capacitor $C_{s1}$. That is to say, there is a connecting path, without the storage capacitor $C_{s1}$ connected thereto, between the voltage boost unit 346 and the plurality of driving units 340, respectively. Furthermore, FIG. 4 can also adopt the design of the voltage boost unit 346 without the storage capacitor $C_{s1}$. That is to say, there is a connecting path, without the storage capacitor $C_{s1}$ connected thereto, between the voltage boost unit 346 and the plurality of driving units 340. FIG. 5 can also adopt the design of the voltage boost units 346, 348 without the storage capacitors $C_{s1}$, $C_{s3}$. That is to say, there is a connecting path, without the storage capacitor $C_{s1}$ connected thereto, between the voltage boost unit 346 and the plurality of driving units 340; and there is a connecting path, without the storage capacitor $C_{s3}$ connected thereto, between the voltage boost unit 348 and the plurality of driving units 340.

Refer again to FIG. 7. The driving unit 340 comprises the driving unit 3400 and the output unit 3402. Accordingly, the voltage boost unit 346 in FIG. 11 requires no storage capacitor $C_{s1}$; it can be designed as having a connecting path, without the storage capacitor $C_{s1}$ connected thereto, between the voltage boost unit 346 and the output unit 3402. Furthermore, FIG. 6 can also adopt the design of the voltage boost unit 346 without the storage capacitor $C_{s1}$. That is to say, there is a connecting path, without the storage capacitor $C_{s1}$ connected thereto, between the voltage boost unit 346 and the plurality of driving units 340.

Besides, please refer to FIGS. 7 and 8 again. The driving unit 340 comprises the differential units 3400, 3404 and the output units 3402, 3406. The voltage boost unit 346 is coupled to the output units 3402, 3406 of the driving unit 340. Thereby, there are connecting paths, without the storage capacitor $C_{s1}$ connected thereto, between the voltage boost unit 346 and the output units 3402, 3406. In addition to the above embodiment, the voltage boost unit 346 can also be coupled to the differential units 3400, 3404 of the driving unit 340. Thereby, there are connecting paths, without the storage capacitor $C_{s1}$ connected thereto, between the voltage boost unit 346 and the differential units 3400, 3404.

Figure 12:
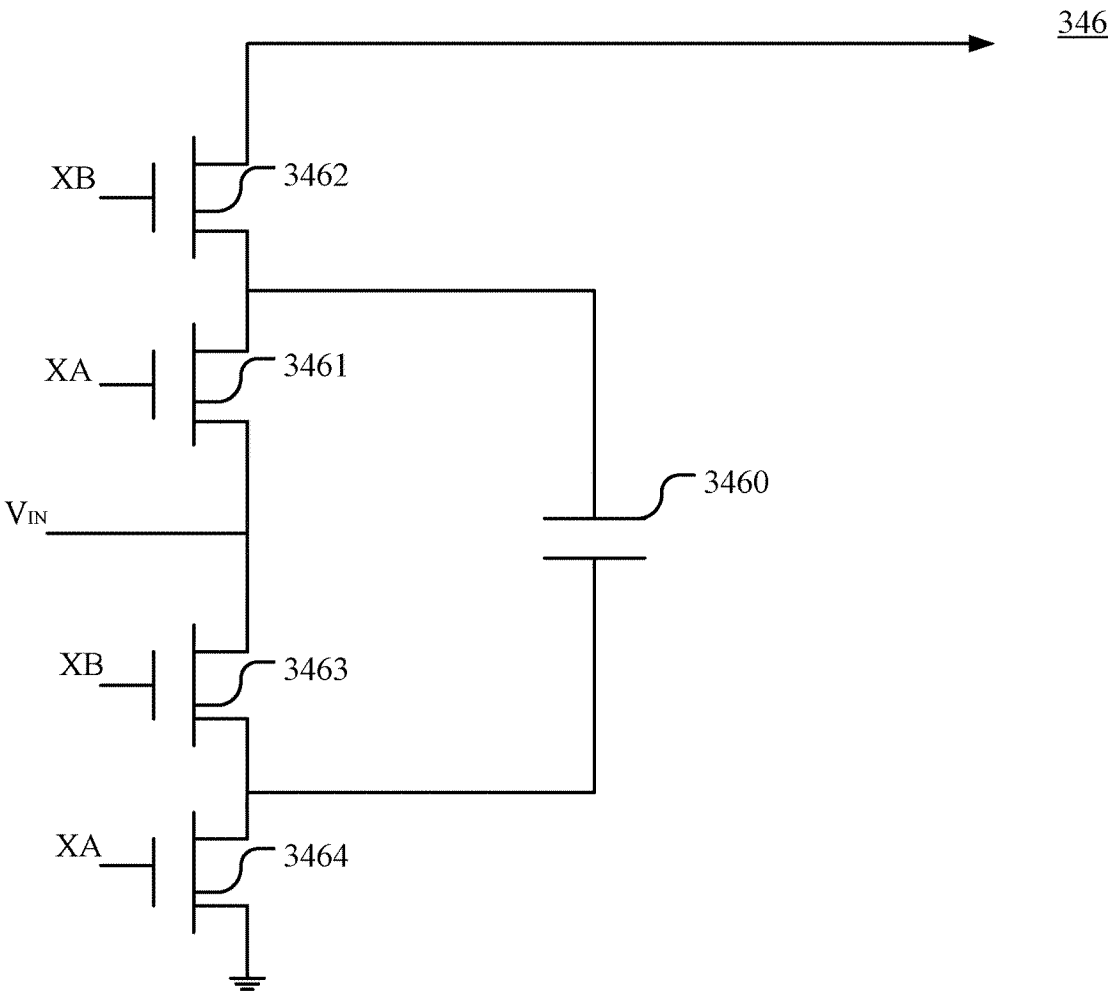
FIG. 12 shows a circuit diagram of the voltage boost unit according a second embodiment of the present invention.

Please refer to FIG. 12, which shows a circuit diagram of the voltage boost unit according to a second embodiment of the present invention. As shown in the figure, the difference between the present embodiment and the one in FIG. 10 is that the voltage boost unit 346 according to the present embodiment requires no storage capacitor $C_{s1}$. Because the voltage boost unit 346 according to the present invention is used for providing the second supply voltage $V_{P2}$ of the plurality of driving units 340, which need to drive the panel (as the display panel in FIG. 4) only and are not responsible for maintaining an accurate supply voltage for the digital-to-analog converting circuit (as the digital-to-analog converting circuit in FIG. 4), it is allowable that no storage capacitor is present and the power supply oscillates significantly. Hence, the voltage boost unit 346 according to the present embodiment only needs the flying capacitor 3460 to produce the second supply voltage $V_{P2}$ and needs no external storage capacitor $C_{s1}$ for supplying the power required by the plurality of driving units 340. Consequently, the circuit area, and hence the cost, can be reduced.

Figure 13:
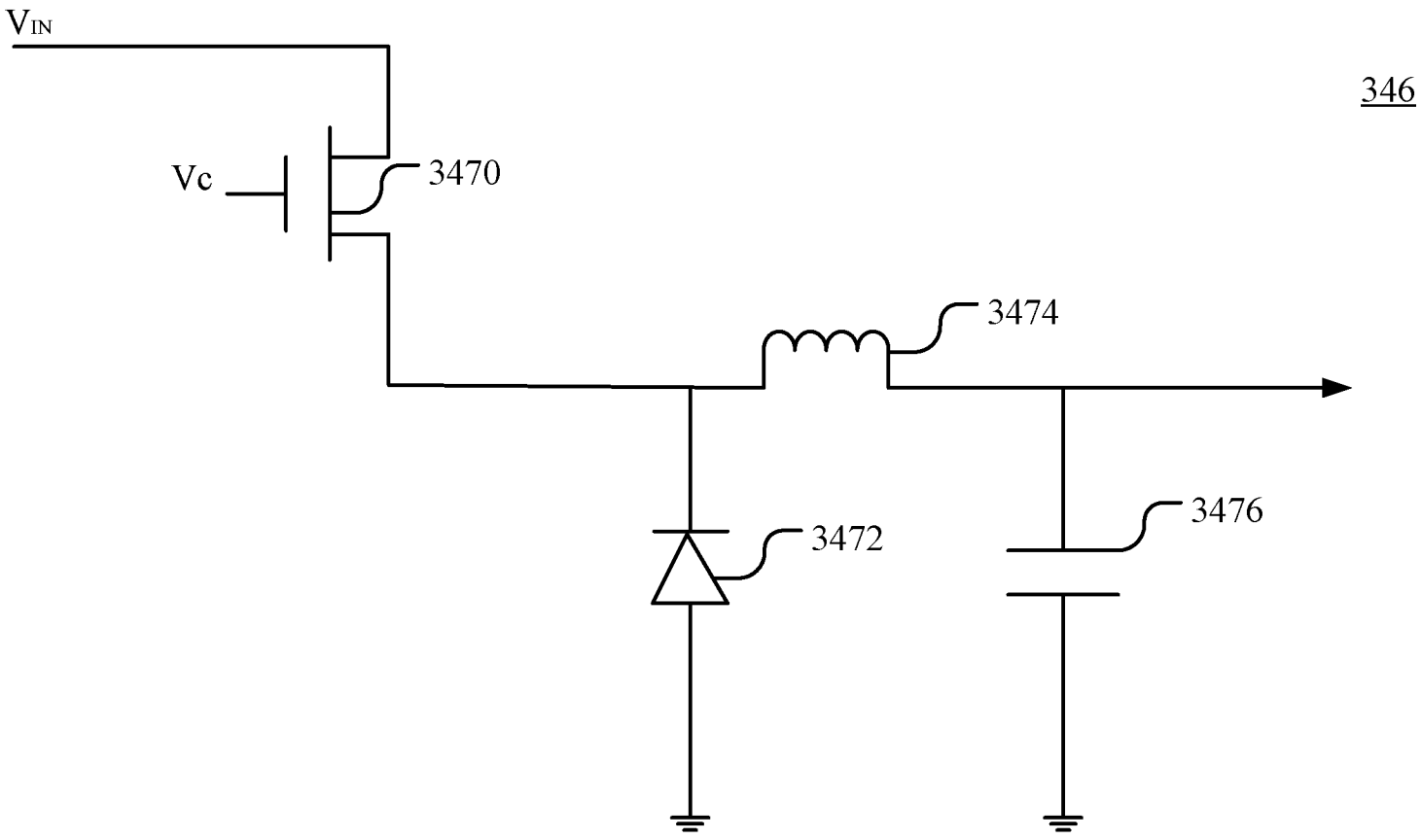
FIG. 13 shows a circuit diagram of the voltage boost unit according a third embodiment of the present invention.

Please refer to FIG. 13, which shows a circuit diagram of the voltage boost unit according a third embodiment of the present invention. As shown in the figure, the difference between the voltage boost unit 346 according to the present embodiment and those according to the embodiments in FIGS. 11 and 12 is that the voltage boost unit 346 according to the present embodiment is an inductive voltage boost unit. The voltage boost unit 346 according to the present embodiment comprises a control transistor 3470, a diode 3472, a storage inductor 3474, and an output capacitor 3476. A terminal of the control transistor 3470 receives the input voltage $V_{IN}$ and is controlled by a control signal $V_C$. A terminal of the diode 3472 is coupled to the control transistor 3470. The other terminal of the diode 3472 is coupled to the ground. The storage inductor 3474 is coupled to the control transistor 3470 and the diode 3472 for storing the energy of the input voltage $V_{IN}$. Besides, a terminal of the output capacitor 3476 is coupled to the storage inductor 3474. The other terminal of the output capacitor 3476 is coupled to the ground for storing the energy of the input voltage $V_{IN}$, producing the second supply voltage $V_{P2}$, and outputting the second supply voltage $V_{P2}$ to the plurality of driving units 340. In conclusion, the voltage boost unit 346 according to the present invention is not limited a capacitive voltage boost unit and an inductive voltage boost unit. Those embodiments having the voltage boost circuit 344 and the voltage boost unit 346 producing the first supply voltage $V_{P1}$ and the second supply voltage $V_{P2}$, respectively, and transmitting the first supply voltage $V_{P1}$ and the second supply voltage $V_{P2}$ to the digital-to-analog converting circuits 342 and the driving units 340, respectively, are within the scope of the present invention.

Furthermore, because the plurality of analog-to-analog converting circuits 342 and the plurality of driving units 340 according to the present invention use different supply voltages provided by the voltage boost circuit 344 and the voltage boost unit 346, respectively, the output capacitor 3476 according to the present embodiment does need a large capacitance. Consequently, instead of connected externally, the output capacitor 3476 according to the present embodiment can be built in a chip. Hence, the circuit area can be saved.

Figure 14B:
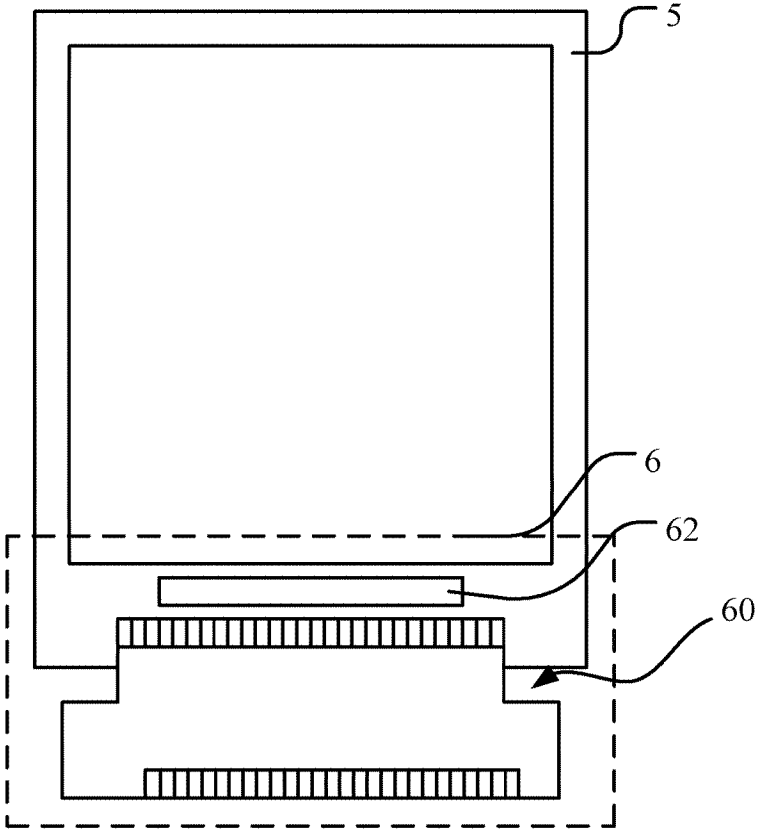
FIG. 14B shows a structural schematic diagram of the display module according to the present invention.
Figure 14A:
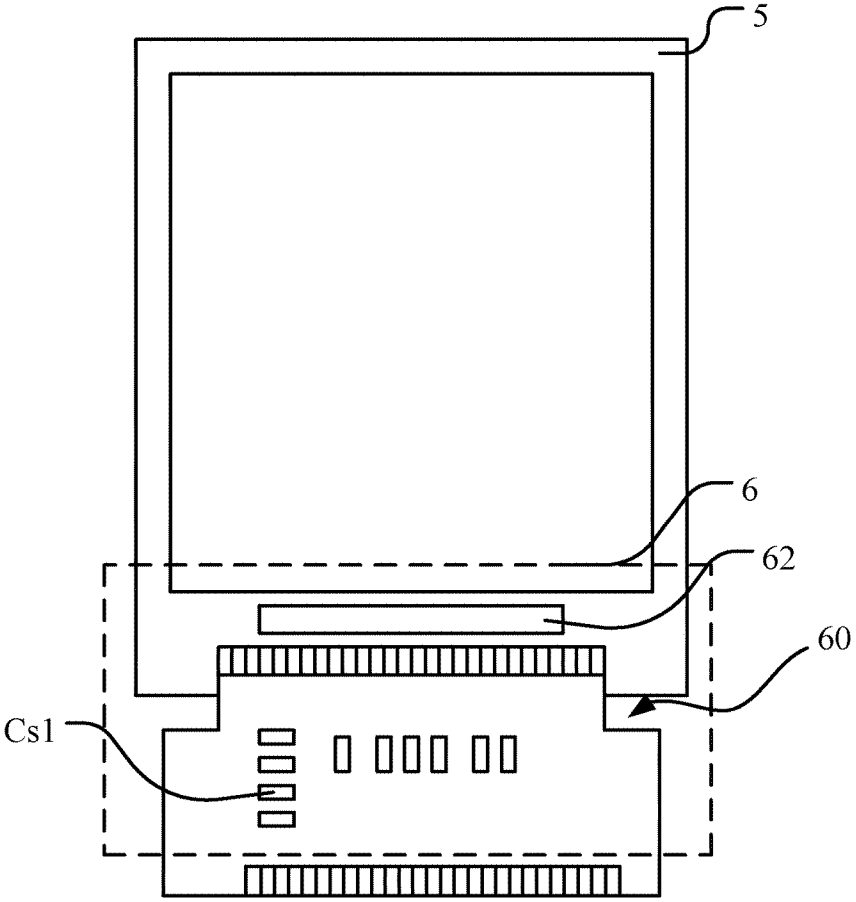
FIG. 14A shows a structural schematic diagram of the display module.

Please refer to FIG. 14A, which shows a structural schematic diagram of the display module. As shown in the figure, the display module comprises the display panel 5 and a driving module 6. The driving module 6 is connected electrically with the display panel 5 for driving the display panel 5 to display images. The driving module 6 comprises flexible circuit board 60 and a driving chip 62. The driving chip 62 is disposed on one side of the display panel 5 and connected electrically with the display panel 5. One side of the flexible circuit board 60 is connected to one side of the display panel 5 and connected electrically with the driving chip 62. According to the present embodiment, the storage capacitor $C_{s1}$ is connected externally to the flexible circuit board 60.

Please refer to FIG. 14B, which shows a structural schematic diagram of the display module according to the present invention. As shown in the figure, the difference between the present embodiment and the one in FIG. 14A is that the driving chip 62 according to the present embodiment comprises the plurality of driving units 340, the plurality of digital-to-analog converting circuits 342, the voltage boost circuit 344, and the voltage boost unit 346. The connections and operations among the plurality of driving units 340, the plurality of digital-to-analog converting circuits 342, the voltage boost circuit 344, and the voltage boost unit 346 are described above and will not be repeated here again. Because the plurality of analog-to-analog converting circuits 342 and the plurality of driving units 340 according to the present invention use individual supply voltages provided by the voltage boost circuit 344 and the voltage boost unit 346, respectively, the storage capacitor $C_{s1}$ required by the driving chip 62 can be shrunk drastically and disposed directly in the driving chip 62. It is not necessary to connect the storage capacitor $C_{s1}$ externally to the flexible circuit board 60, or the driving chip 62 even requires no external storage capacitor. Thereby, the circuit area can be saved, and thus achieving the purpose of saving cost.

Figure 15:
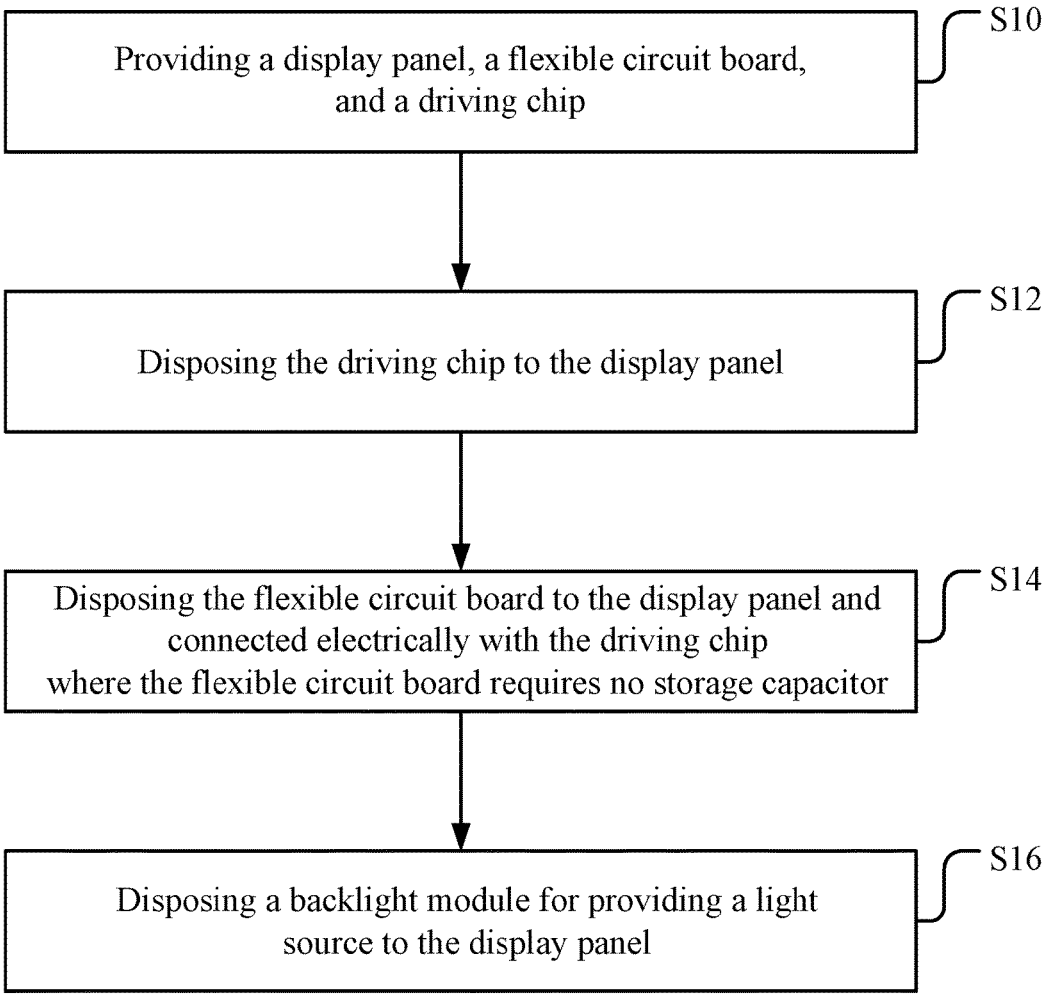
FIG. 15 shows a flowchart of the method for manufacturing the display panel.

Please refer to FIG. 15, which shows a flowchart of the method for manufacturing the display panel. As shown in the figure, first, the step S10 is executed for providing the display panel 5, the flexible circuit board 60, and the driving chip 62. Then, the step S12 is executed for disposing the driving chip 62 to the display panel 5, as shown in FIG. 14A. Next, the step S14 is executed for disposing the flexible circuit board 60 to the display panel and connected electrically with the driving chip 5. In addition, it is not necessary to dispose a storage capacitor $C_{s1}$ on the flexible circuit board 60, as shown in FIG. 14B.

Accordingly, because the plurality of analog-to-analog converting circuits 342 and the plurality of driving units 340 according to the present invention use individual supply voltages provided by the voltage boost circuit 344 and the voltage boost unit 346, respectively, the storage capacitor $C_{s1}$ required by the driving chip 62 can be shrunk drastically and disposed directly in the driving chip 62. It is not necessary to connect the storage capacitor $C_{s1}$ externally to the flexible circuit board 60, or the driving chip 62, namely, the driving circuit, even requires no external storage capacitor. Thereby, according to the present invention, the process of connecting the storage capacitor externally to the flexible circuit board 60 can be saved and thus shortening the process time and further saving cost.

Moreover, the method for manufacturing the display panel according to the present invention further comprises a step S16 for disposing a backlight module (not shown in the figure) for providing a light source to the display panel 5.

To sum up, the present invention relates to a driving circuit of a display panel. A plurality of driving units produce a reference driving voltage according to a gamma voltage of a gamma circuit, respectively. A plurality of digital-to-analog converting circuits receive the reference driving voltages output by the plurality of driving units, and select one of the plurality of reference driving voltage as a data driving voltage according to pixel data, respectively. The plurality of digital-to-analog converting circuits transmit the plurality of data driving voltages to the display panel for displaying images. A voltage boost circuit is used for producing a first supply voltage and providing the first supply voltage to the plurality of digital-to-analog converting circuits. At least a voltage boost unit is used for producing a second supply voltage and providing the second supply voltage to the plurality of driving units. Thereby, because the plurality of analog-to-analog converting circuits and the plurality of driving units according to the present invention use different supply voltages provided by the voltage boost circuit and the voltage boost unit, respectively, the area occupied by the storage capacitor can be minimized or even no external storage capacitor is required. Thereby, the circuit area can be saved, and thus achieving the purpose of saving cost.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

What is claimed is:

1. A driving module of a display panel, comprising:

a flexible circuit board, connected electrically with said display panel; and a driving chip, disposed beside one side of said flexible circuit board, and comprising:

a plurality of driving circuits, each driving circuit producing a reference driving voltage according to a gamma voltage of a gamma circuit;

a plurality of digital-to-analog converting circuits, each digital-to-analog converting circuit receiving said plurality of reference driving voltages output by said plurality of driving circuits, selecting one of said plurality of reference driving voltages as a data driving voltage according to pixel data, and transmitting said plurality of data driving voltages to said display panel for displaying images;

a first voltage boost circuit, producing a first supply voltage, and providing said first supply voltage to said plurality of digital-to-analog converting circuits through a first output line, said plurality of digital-to-analog converting circuits being powered by said first supply voltage; and a plurality of second voltage boost circuits, producing a second supply voltage, and providing said second supply voltage to said plurality of driving circuits through a second output line being independent of said first output line, said plurality of driving circuits being powered by said second supply voltage, wherein said first voltage boost circuit and said plurality of second voltage boost circuits operate independently from each other.

2. The driving module of claim 1, wherein said first voltage boost circuit and said second voltage boost circuits provide respective said first and second supply voltages that are independent relative to each other.

3. A display device, comprising:

a display panel, displaying an image;

a flexible circuit board, connected electrically with said display panel; and a driving chip, disposed beside one side of said flexible circuit board, producing a plurality of data driving voltages to said display panel for displaying said image, and comprising:

a plurality of driving circuits, each driving circuit producing a reference driving voltage according to a gamma voltage of a gamma circuit;

a plurality of digital-to-analog converting circuits, each digital-to-analog converting circuit receiving said plurality of reference driving voltages output by said plurality of driving circuits, selecting one of said plurality of reference driving voltages as a data driving voltage according to pixel data, and transmitting said plurality of data driving voltages to said display panel;

a first voltage boost circuit, producing a first supply voltage, and providing said first supply voltage to said plurality of digital-to-analog converting circuits through a first output line, said plurality of digital-to-analog converting circuits being powered by said first supply voltage; and a plurality of second voltage boost circuits, producing a second supply voltage, and providing said second supply voltage to said plurality of driving circuits through a second output line being independent of first output line, said plurality of driving circuits being powered by said second supply voltages;

wherein said first voltage boost circuit and said plurality of second voltage boost circuits operate independently from each other.

4. The display device of claim 3, wherein said first voltage boost circuit and said second voltage boost circuits provide respective said first and second supply voltages that are independent relative to each other.

5. A data driving circuit of a display panel, comprising:

a plurality of digital-to-analog converting circuits, each digital-to-analog converting circuit receiving a plurality of gamma voltages of a gamma circuit, and selecting one of said plurality of gamma voltages as a reference driving voltage according to pixel data;

a plurality of driving circuits, each driving circuit receiving said reference driving voltage output by said plurality of digital-to-analog converting circuits, producing a data driving voltage according to said reference driving voltage, and transmitting said data driving voltage to said display panel for display images;

a first voltage boost circuit, producing a first supply voltage, and providing said first supply voltage to said plurality of digital-to-analog converting circuits through a first output line, said plurality of digital-to-analog converting circuits being powered by said first supply voltage; and a plurality of second voltage boost circuits, independent of said first voltage boost circuit, producing a second supply voltage, and providing said second supply voltage to said plurality of driving circuits through a second output line being independent of said first output line, said plurality of driving circuits being powered by said second supply voltage;

where each driving circuit comprises:

a differential circuit, receiving said first supply voltage as the power supply, and producing a differential voltage according to said gamma voltage; and an output circuit, receiving said second supply voltage as the power supply, and producing said data driving voltage according to said differential voltage.

6. The display circuit of claim 5, wherein said first voltage boost circuit and said second voltage boost circuits provide respective said first and second supply voltages that are independent relative to each other, said first voltage boost circuit and said second voltage boost circuits operate independently from each other.

7. A driving module of a display panel, comprising:

a flexible circuit board, connected electrically with said display panel; and a driving chip, disposed beside one side of said flexible circuit board, and comprising:

a plurality of digital-to-analog converting circuits, each digital-to-analog converting circuit receiving a plurality of gamma voltages of a gamma circuit, and selecting one of said plurality of gamma voltages as a reference driving voltage according to pixel data;

a plurality of driving circuits, each driving circuit receiving said reference driving voltage output by said plurality of digital-to-analog converting circuits, producing a data driving voltage according to said reference driving voltage, and transmitting said data driving voltage to said display panel for display images;

a first voltage boost circuit, producing a first supply voltage, and providing said first supply voltage to said plurality of digital-to-analog converting circuits through a first output line, said plurality of digital-to-analog converting circuits being powered by said first supply voltage; and at least a second voltage boost circuit, independent of said first voltage boost circuit, producing a second supply voltage, and providing said second supply voltage to said plurality of driving circuits through a second output line being independent of said first output line, said plurality of driving circuits being powered by said second supply voltage;

where each driving circuit comprises:

a differential circuit, receiving said first supply voltage as the power supply, and producing a differential voltage according to said gamma voltage; and an output circuit, receiving said second supply voltage as the power supply, and producing said data driving voltage according to said differential voltage.

8. The display module of claim 7, wherein said first voltage boost circuit and said at least second voltage boost circuit provide respective said first and second supply voltages that are independent relative to each other, said first voltage boost circuit and said at least second voltage boost circuit operate independently from each other.

9. A driving module of a display panel, comprising:

a flexible circuit board, connected electrically with said display panel; and a driving chip, disposed beside one side of said flexible circuit board, and comprising:

a plurality of digital-to-analog converting circuits, each digital-to-analog converting circuit receiving a plurality of gamma voltages of a gamma circuit, and selecting one of said plurality of gamma voltages as a reference driving voltage according to pixel data;

a plurality of driving circuits, each driving circuit receiving said reference driving voltage output by said plurality of digital-to-analog converting circuits, producing a data driving voltage according to said reference driving voltage, and transmitting said data driving voltage to said display panel for display images;

a first voltage boost circuit, producing a first supply voltage, and providing said first supply voltage to said plurality of digital-to-analog converting circuits through a first output line, said plurality of digital-to-analog converting circuits being powered by said first supply voltage; and a plurality of second voltage boost circuits, independent of said first voltage boost circuit, producing a second supply voltage, and providing said second supply voltage to said plurality of driving circuits through a second output line being independent of said first output line, said plurality of driving circuits being powered by said second supply voltage;

where each driving circuit comprises:

a differential circuit, receiving said first supply voltage as the power supply, and producing a differential voltage according to said gamma voltage; and an output circuit, receiving said second supply voltage as the power supply, and producing said data driving voltage according to said differential voltage.

10. The display module of claim 9, wherein said first voltage boost circuit and said second voltage boost circuits provide respective said first and second supply voltages that are independent relative to each other, said first voltage boost circuit and said second voltage boost circuits operate independently from each other.

11. A display device, comprising:

a display panel, displaying an image; a flexible circuit board, connected electrically with said display panel; and a driving chip, disposed beside one side of said flexible circuit board boards, producing a plurality of data driving voltages to said display panel for displaying said image, and comprising:

a plurality of digital-to-analog converting circuits, each digital-to-analog converting circuit receiving a plurality of gamma voltages of a gamma circuit, and selecting one of said plurality of gamma voltages as a reference driving voltage according to pixel data;

a plurality of driving circuits, each driving circuit receiving said reference driving voltage output by said plurality of digital-to-analog converting circuits, producing a data driving voltage according to said reference driving voltage, and transmitting said data driving voltage to said display panel for display images;

a first voltage boost circuit, producing a first supply voltage, and providing said first supply voltage to said plurality of digital-to-analog converting circuits through a first output line, said plurality of digital-to-analog converting circuits being powered by said first supply voltage; and at least a second voltage boost circuit, independent of said first voltage boost circuit, producing a second supply voltage, and providing said second supply voltage to said plurality of driving circuits through a second output line being independent of said first output line, said plurality of driving circuits being powered by said second supply voltage;

where each driving circuit comprises:

a differential circuit, receiving said first supply voltage as the power supply, and producing a differential voltage according to said gamma voltage; and an output circuit, receiving said second supply voltage as the power supply, and producing said data driving voltage according to said differential voltage.

12. The display device of claim 11, wherein said first voltage boost circuit and said at least second voltage boost circuit provide respective said first and second supply voltages that are independent relative to each other, said first voltage boost circuit and said at least second voltage boost circuit operate independently from each other.

13. A display device, comprising:

a display panel, displaying an image;

a flexible circuit board, connected electrically with said display panel; and a driving chip, disposed beside one side of said flexible circuit board boards, producing a plurality of data driving voltages to said display panel for displaying said image, and comprising:

a plurality of digital-to-analog converting circuits, each digital-to-analog converting circuit receiving a plurality of gamma voltages of a gamma circuit, and selecting one of said plurality of gamma voltages as a reference driving voltage according to pixel data;

a plurality of driving circuits, each driving circuit receiving said reference driving voltage output by said plurality of digital-to-analog converting circuits, producing a data driving voltage according to said reference driving voltage, and transmitting said data driving voltage to said display panel for display images;

a first voltage boost circuit, producing a first supply voltage, and providing said first supply voltage to said plurality of digital-to-analog converting circuits through a first output line, said plurality of digital-to-analog converting circuits being powered by said first supply voltage; and a plurality of second voltage boost circuits, independent of said first voltage boost circuit, producing a second supply voltage, and providing said second supply voltage to said plurality of driving circuits through a second output line being independent of said first output line, said plurality of driving circuits being powered by said second supply voltage;

where each driving circuit comprises:

a differential circuit, receiving said first supply voltage as the power supply, and producing a differential voltage according to said gamma voltage; and an output circuit, receiving said second supply voltage as the power supply, and producing said data driving voltage according to said differential voltage.

14. The display device of claim 13, wherein said first voltage boost circuit and said second voltage boost circuits provide respective said first and second supply voltages that are independent relative to each other, said first voltage boost circuit and said second voltage boost circuits operate independently from each other.

* * * * *